United States Patent [19]

Furey

[11] Patent Number: 4,798,107

[45] Date of Patent: Jan. 17, 1989

[54] NAIL HOLDING ATTACHMENT FOR A HAMMER

[76] Inventor: Thomas Furey, 218 Middlesex Ave., Voorhees, N.J. 08043

[21] Appl. No.: 47,266

[22] Filed: May 8, 1987

[51] Int. Cl.[4] ..... B25C 1/00

[52] U.S. Cl. ..... 81/23

[58] Field of Search ..... 81/23, 24, 44; 7/143, 7/146, 147, 170; 24/31 V, 300-302, 3 R, 3 M

[56] References Cited

U.S. PATENT DOCUMENTS 1,247,683 11/1917 Hritz ..... 81/23
1,411,567 4/1922 Fisher ..... 81/23
2,722,251 11/1955 Dillon ..... 81/23
4,432,504 2/1984 Pace ..... 24/31 V
4,596,540 6/1986 F'Geppert ..... 24/31 V

*Primary Examiner*—James G. Smith
*Attorney, Agent, or Firm*—Panitch Schwarze Jacobs & Nadel

[57] ABSTRACT

A hammer attachment comprising a loop engagable about a hammer handle closely beneath the hammer head, a strap engaged outwardly about the hammer head onto opposite sides of the head and there secured to opposite regions of the loop, and at least one nail head receiver on the strap for holding a nail to be started.

7 Claims, 1 Drawing Sheet

NAIL HOLDING ATTACHMENT FOR A HAMMER

BACKGROUND OF THE INVENTION

As is well known to those versed in the art of carpentry, and particularly that of building houses, the hammering of nails generally required both hands of the carpenter, one to hold the nail during starting in the wood, and the other to swing the hammer. This two-handed operation severly limits the area to which one can reach, for example, from a ladder, to require much movement and expenditure of time and energy.

In order to minimize or reduce this problem, there have been provided in the prior art a number of hammers and attachments therefore serving to hold nails during starting, all as a one-hand operation. For example, applicant is aware of the below listed prior art:

| U.S. Patents | |
|---|---|
| U.S. Pat. No. | Patentee |
| 35,885 | Mills et al |
| 193,967 | Knight |
| 794,310 | Priestley |
| 825,560 | Smith |
| 1,029,934 | J. R. Kidd |
| 1,209,583 | Holmdahl |
| 1,247,683 | Hritz et al |
| 1,365,778 | Galligan |
| 1,387,920 | Busse |
| 1,411,567 | Fisher |
| 2,227,455 | Lane |
| 2,574,304 | B. Vigil |
| 2,722,251 | F. F. Dillon |
| 2,983,297 | J. M. Wilson |
| 4,270,587 | Ludy |

| Foreign Patents | | | |
|---|---|---|---|
| Country | Patent No. | Patentee | Date |
| Norway | 72,002 | Johannessen | 4/1947 |
| Switzerland | 566,846 | Vigil | 9/1975 |

However, the devices of the prior patents are relatively expensive, even the hammer attachments, being necessarily of metal and involving expensive manufacturing procedures. Also, the prior art devices are relatively complex, bulky in size and heavy in weight to detract from their convenience in use. Also, even the prior art attachments are relatively difficult to attach or subject to inadvertent removal when not desired; and, prior art attachments are not capable of use with a variety of different sizes and types of hammers.

SUMMARY OF THE INVENTION

Accordingly, it is an important object of the present invention to provide a hammer attachment for holding nails during starting, which attachment both overcomes the above mentioned difficulties, being extremely light in weight and of minimum bulk for optimum convenience in use, capable of manufacture out of textiles for extreme economy of labor and materials, and which is uniquely adapted to fit hammers of greatly varing sizes, shapes and types so that a single one of such attachments is capable of great versitility in use.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scop will be indicated by the appended claims.

DESCRIPTION OF THE PREFERRED EMBODIMENT

Figure 1:
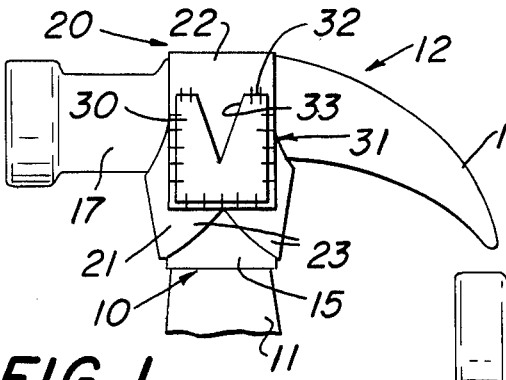
FIG. 1 is a side elevational view of a hammer including a nail holding attachment of the present invention.
Figure 2:
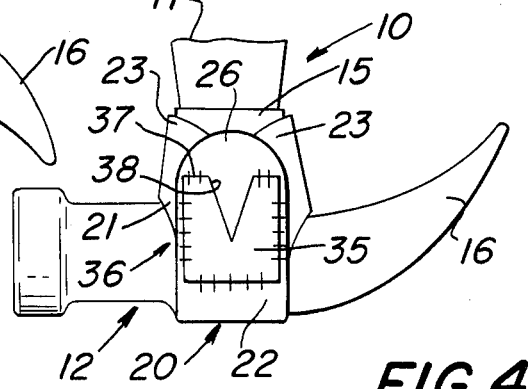
FIG. 2 side elevational view of the hammer and attachment of FIG. 1 with the hammer inverted to show its other side and the attachment.

Referring now more particularly to the drawings, and specifically to FIGS. 1 and 2 thereof, a hammer is there generally designated 10, and includes an elongate handle or helve 11, on one end of which is a transverse head, generally designated 12.

The hammer head 12 is there generally illustrated as of the claw type, which is commonly used in house building, but the hammer may be of other type, if desired.

In the illustrated embodiment the head includes a central sleeve or eye 15 for receiving the adjacent end of handle 11, and extending oppositely from the sleeve may be a claw 16 and a poll 17. As thus far described, the hammer 10 may be conventional.

Applied to the hammer 10 is the attachment of the present invention, being a nail holder snugly embracing the hammer and a generally designated 20.

Figure 5:
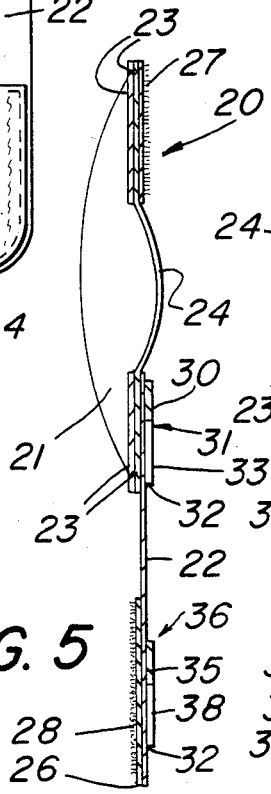
FIG. 5 a plane view showing the attachment of the present invention apart from the hammer.
Figure 6:
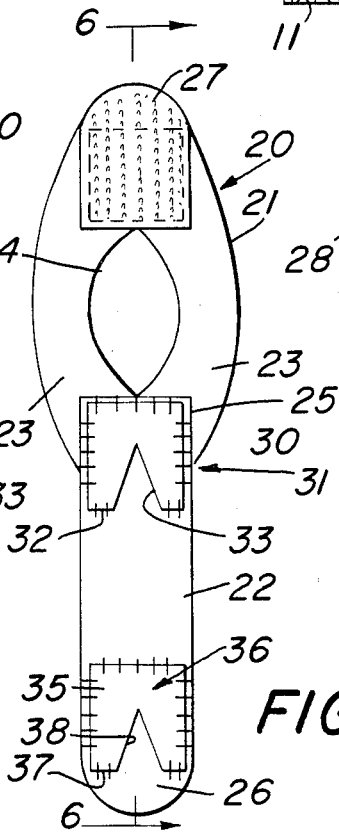
FIG. 6 is a longitudinal sectional view taken generally along the line 6—6 of FIG. 5.

The nail holder attachment 20 is shown in FIGS. 5 and 6 apart the hammer, and includes a generally ovaloid collar or loop 21 to one end of which is attached one end of a strap 22. The loop 21 may be fabricated of a pair of elastic strips 23, which may be essentially identical, having their opposite ends secured together, as by stiching, or the like, and combining to define an outline configuration approximating the sector of a sphere and having a central through opening, as at 24.

The strap 22 may advantageously also be fabricated of elastic tape and suitably secured, as at one end region 25 by stitching or other securing means to one end portion of the elongate loop 21. From its secured end 25 the strap 22 extends longitudinally of and outwardly from the ovaloid 21 to terminate in a free end portion 26.

Carried by the elongate loop 21, at its end remote from the strap 22, is a fastener element 27, which may advantageously be a patch of fastener fabric of the type sold as "VELCRO". The fastener fabric is shown on the upper or exposed surface of the loop 21 in FIG. 5; and, the strap end portion 25 may also be secured on the exposed or upper surface of the loop 21 seen in FIG. 5.

Figure 3:
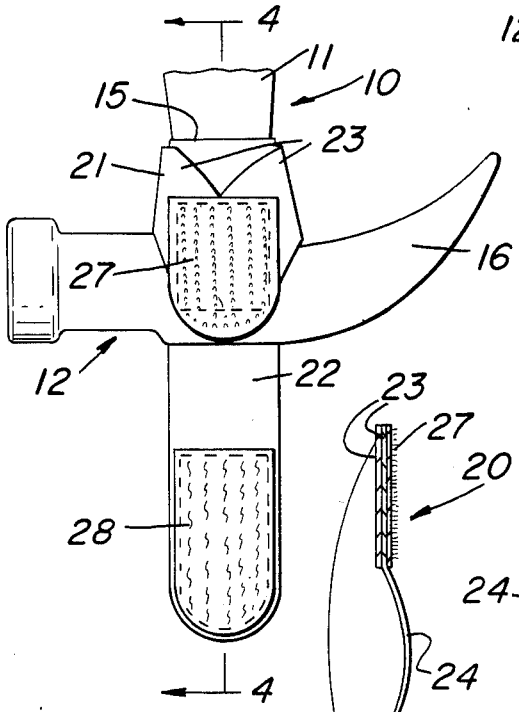
FIG. 3 is a side elevational view similar to FIG. 2 showing the attachment in a partially attached or detached condition.

On the other side of the distal or remote end portion 26 of the strap 22, as seen in FIG. 3, better seen in FIG. 6, may be an additional patch 28 of fastener fabric, suitably secured by stitching or other securing means. That is, the fastener fabric patch 28 is adapted to mate in detachable securing engagement with the fastener fabric patch 27, in a manner appearing presently.

Secured on the upper or exposed surface of strap 22, overlying the inner end portion 25 may be a pocket patch 30 combining with the underlying strap end portion 25 to define a pocket or nail head receiver 31. The pocket patch 30 may be suitably secured, as by stitching or other securing means.

More specifically, the pocket patch 30 may be generally rectangular, having one edge 32 outward of the loop 21 unsecured to the strap 22 and formed with an inwardly tapering cut-out or V-shaped notch 33. By this construction, a nail is adapted to be received by the pocket 31 with the nail head beneath the pocket patch 30 and the nail shank frictionally engaged by the converging edges of cut-out 33.

The distal, opposite end of the strap 32 is similarly provided with a pocket patch 35 suitably secured in facing relation with the strap end portion 26 to define a nail receiving pocket 36. The pocket patch 35 may also be generally rectangular, having its outer edge 37 medially cut away to define a generally V-shaped notch or cut-out 38.

Figure 4:
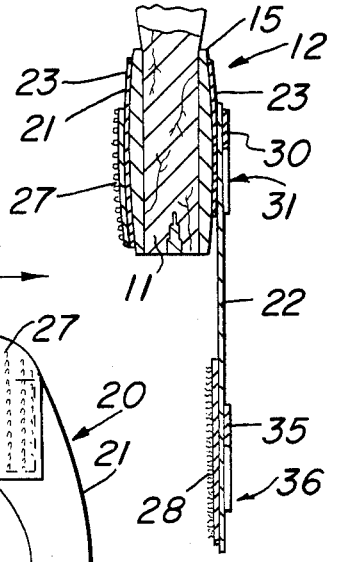
FIG. 4 is a sectional elevational view taken generally along the line 4—4 of FIG. 3.

In order to assemble the nail holding attachment 20 to the hammer 10, the loop 21 is engaged in circumposed relation about the handle 11 and moved upwardly closely adjacent to the hammer head 12 surrounding the handle sleeve. This is done with the fastener fabric patch 27 and strap 22 outwardly and on opposite sides of the hammer head. Such an intermediate stage of assembly is shown in FIGS. 3 and 4. Assembly may be readily completed by merely wrapping the strap 22 outwardly about the hammer head 12, so that the strap has its opposite ends on opposite sides of the hammer head. Also, the fastener fabric patches 27 and 28 are in secured facing engagement with each other to effectively retain the attachment snuggly about the sleeve 15 and embracing the head. The elasticity of the loop straps 23, and of the strap 22 facilitate obtaining this snug embracing engagement of the attachment about the hammer head. In this condition, as seen in FIGS. 1 and 2 it will be apparent that the pockets 31 and 36 are on opposite sides of the hammer head with the pocket notches 33 and 38 extending in opposite directions longitudinally of the hammer handle. In this manner, the pocket 31 may define a receiver for a nail to be impaled in an overhead position, while the pocket 36 provides a receiver for a nail to be impaled in a lower position, as when a hammer head is downward.

It is believed apparent that the attachment 20 may be quickly and easily removed by mere reversal of the above described assembly procedure. That is, merely peeling the strap end portion 26, as seen in FIG. 2, away from the loop 21 to detach the fabric fasteners 27 and 28 will return the attachment to the condition shown in FIGS. 3 and 4. The loop 21 may then merely be slipped off of the handle 11 to entirely separate the attachment from the hammer.

From the foregoing, it will be appreciated that the hammer attachment of the present invention will effectively hold nails for starting in substantially any hammer position, is extremely simple and economical in construction, capable of use with substantially all types and sizes of hammers and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A nail holding attachment for a hammer having an elongate handle and a transverse head, said attachment comprising a closed loop of stretchable elastic fabric engageable about a hammer handle coaxially with the handle, a strap having one end connected to said loop for extension therefrom over the hammer head, fastener means connecting the other strap end to said loop, and at least one nail head receiver on said strap for hoding a nail to be started.

2. A nail holding attachment according to claim 1, said loop being elastic for snug engagement about a hammer closely beneath the hammer head.

3. A nail holding attachment according to claim 1, said strap being snuggly engaged outwardly about the hammer head onto opposite sides of the head, said nail head receiver being at one end of said strap for location on one side of the hammer head.

4. A nail holding attachment according to claim 3, in combination with an additional nail head receiver at the other end of said strap for location on the other side of the hammer head, said first mentioned and additional nail head receivers facing in opposite directions relative to the hammer for holding nails with the hammer in opposite positions.

5. A nail holding attachment according to claim 1, said fastener means comprising mating fastener fabrics on said loop and strap.

6. A nail holding attachment according to claim 5, said strap being elastic for snug engagement about the hammer head and selectively adjustable securement of the fastener fabrics.

7. A nail holding attachment according to claim 1, said nail head receiver comprising a pocket on said strap having one end closed and the other end opened and converging toward its closed end for retaining engagement with a received nail.

* * * * *